US005145347A

United States Patent [19]

Freeman

[11] Patent Number: 5,145,347

[45] Date of Patent: Sep. 8, 1992

[54] GEROTOR PUMP WITH BLIND-END GROOVE ON EACH LOBE OF THE ANNULUS

[75] Inventor: Richard R. Freeman, Alcester, England

[73] Assignee: Concentric Pumps Limited, England

[21] Appl. No.: 721,274

[22] Filed: Jun. 26, 1991

[30] Foreign Application Priority Data

Jun. 30, 1990 [GB] United Kingdom ..... 9014601

[51] Int. Cl.[5] ..... F04C 2/10

[52] U.S. Cl. ..... 418/77; 418/171

[58] Field of Search ..... 418/77, 78, 171, 170, 418/169, 168, 167, 166

[56] References Cited

U.S. PATENT DOCUMENTS 4,235,217 11/1980 Cox ..... 418/171

FOREIGN PATENT DOCUMENTS 59-126094 7/1984 Japan ..... 418/171

61-83491 4/1986 Japan ..... 418/77

*Primary Examiner*—John J. Vrablik

*Assistant Examiner*—David L. Cavanaugh

*Attorney, Agent, or Firm*—Learman & McCulloch

[57] ABSTRACT

A gerotor set (FIG. 1) has grooves 108 extending across the end face of the annulus adjacent the outlet port so as to allow flow from each chamber in turn into the outlet at a time when the chamber per se is not yet registered with the outlet, so as to prevent noise due to the trapped volume being compressed when it is unable to escape into either port.

9 Claims, 5 Drawing Sheets

GEROTOR PUMP WITH BLIND-END GROOVE ON EACH LOBE OF THE ANNULUS

BACKGROUND OF THE INVENTION

This invention relates to gerotor pumps which comprise a male lobed rotor meshed with an internally lobed annulus. The annulus has at least one more lobe than the rotor, and the contact lines between those two parts define boundaries of chambers which vary in volume during the rotation of the parts. The volume increases for induction of working fluid through an inlet port in approximately 180 deg. of the revolution and decreases for ejection of fluid through an outlet port in the other half of the cycle. The axes of the rotor and annulus lie in a plane which intersects the 0 deg. and 180 deg. positions.

The ports do not extend over the full 180 degrees, for a land is provided between the two ports at each of two diametric positions and the land is about equal to the circumferential dimension of one pump chamber, for the purpose of isolating the inlet from the outlet at the two positions.

In U.S. Pat. No. 3,905,727 a pump of this kind has radial grooves in the end faces of the annulus which extend from each interlobe position. Each in turn forms part of the sole flow path leading to and from the outlet and inlet port respectively.

EPA 242963 uses ports opening direct to the end faces of the chambers but one of the ports (the outlet) is divided by a web as shown in FIG. 2 of the drawings of that specification, which creates a dead spot limiting or preventing flow: in order to avoid a pressure ripple which would thus occur, the end face of the rotor has radial grooves which are of a circumferential width in excess of the width of the web, in order to allow flow from the chamber into the port around the web via the groove so that the flow may be continuous irrespective of position.

In BP A233423 the leading edges of the rotor lobes or the trailing edges of the annulus lobes are chamfered so as to connect all the chambers together via the chamfers, for the purpose of giving rapid influx to the chambers.

The inventor has discovered that noise from gerotor pumps results from pressure variations in trapped volumes. Thus if the land width exceeds the chamber width, the chamber volume will vary as it moves across the land. This can cause hammer in compression, or (which is also bad) cavitation and bubble formation in expansion. However, there are dynamic effects at work when the pump is in use which produce unexpected results when considering the geometry of the stationary parts, and this complicates the design of the land and changes the needful symmetry or asymmetry of the ports, so that it is rarely sufficient to provide a simple land of precisely the chamber width. If this is done, noise may still ensue, and pump efficiency may be lowered elsewhere.

SUMMARY OF THE INVENTION

The objects of the invention are to provide improved pumps.

According to the invention the annulus of a gerotor pump is provided on its planar face adjacent inlet and outlet ports with a series of grooves each extending in a circumferential direction, and each extending only partway across the corresponding one of the lobes and intersecting with one of the flanks of each lobe.

The intersection is with a selected face of the lobe having regard to the direction of rotation but alternative possibilities exist as explained hereinbelow.

Because the grooves are blind-ended in the width of the lobe, there will be no continuous connection between chambers.

BRIEF DESCRIPTION OF THE DRAWING

Presently preferred embodiments of the invention are now more particularly described with reference to the accompanying drawings wherein.

DESCRIPTION OF THE PREFERRED EMBODIMENT

Figure 1:
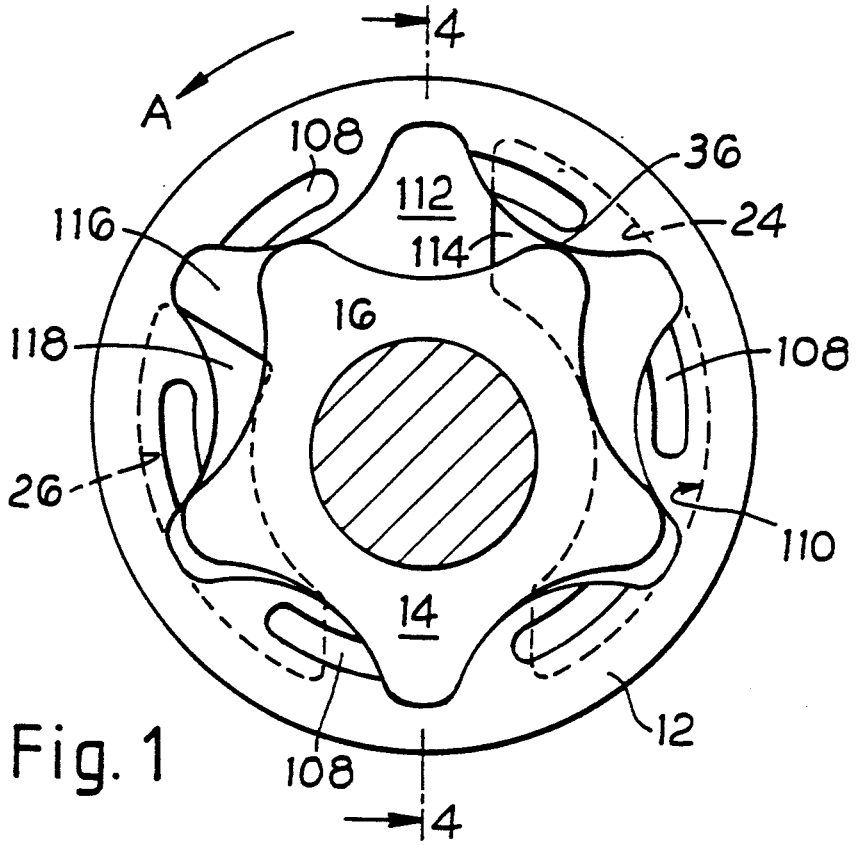
FIGS. 1-3 are sectional elevations of a gerotor pump showing the rotor and annulus, and the inlet and outlet ports only.

Turning now to the drawings, the pump comprises a body 10 having a cylindrical cavity which journals annulus 12 in which is meshed rotor 14 carried on shaft 16 driven by gear 18 and journalled on bushes 20. Inlet and outlet ports are provided. Assuming the direction of rotation is that of the arrow A, then the inlet port is shown by the outline 24 and the outlet port by the outline 26 in FIG. 1.

Figure 3:
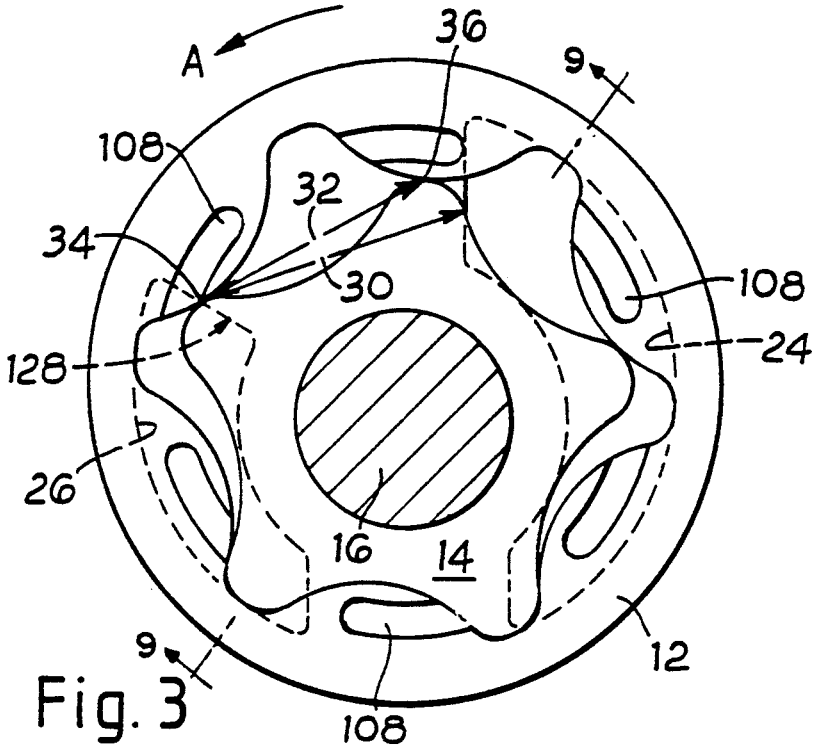
Figure 4:
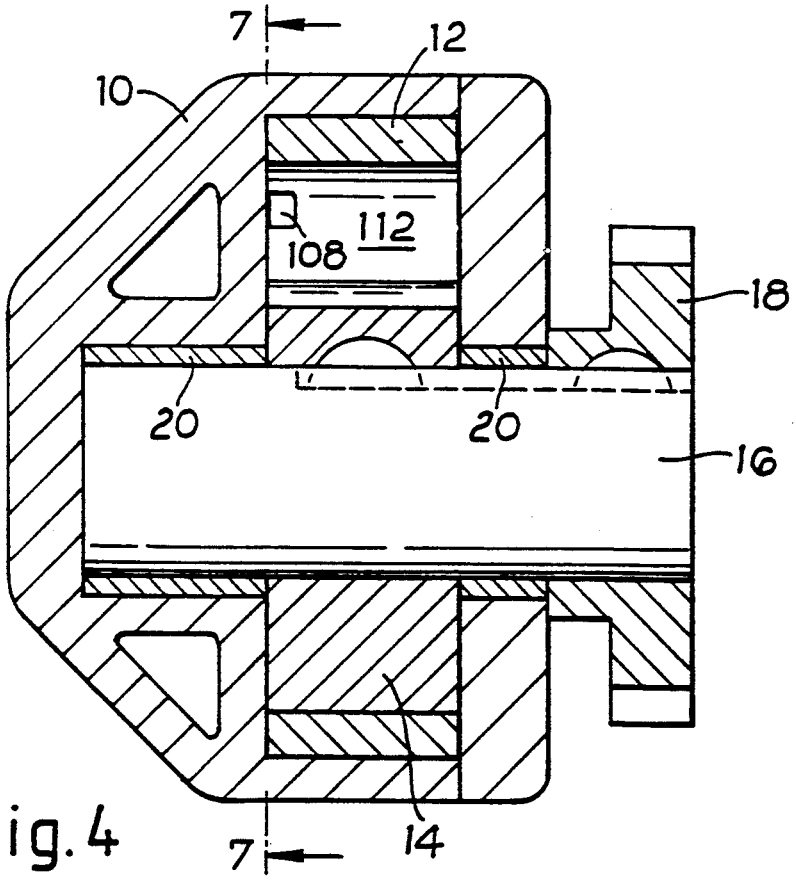
FIG. 4 is a sectional side elevation taken on the line 4—4 of FIG. 1.
Figure 5:
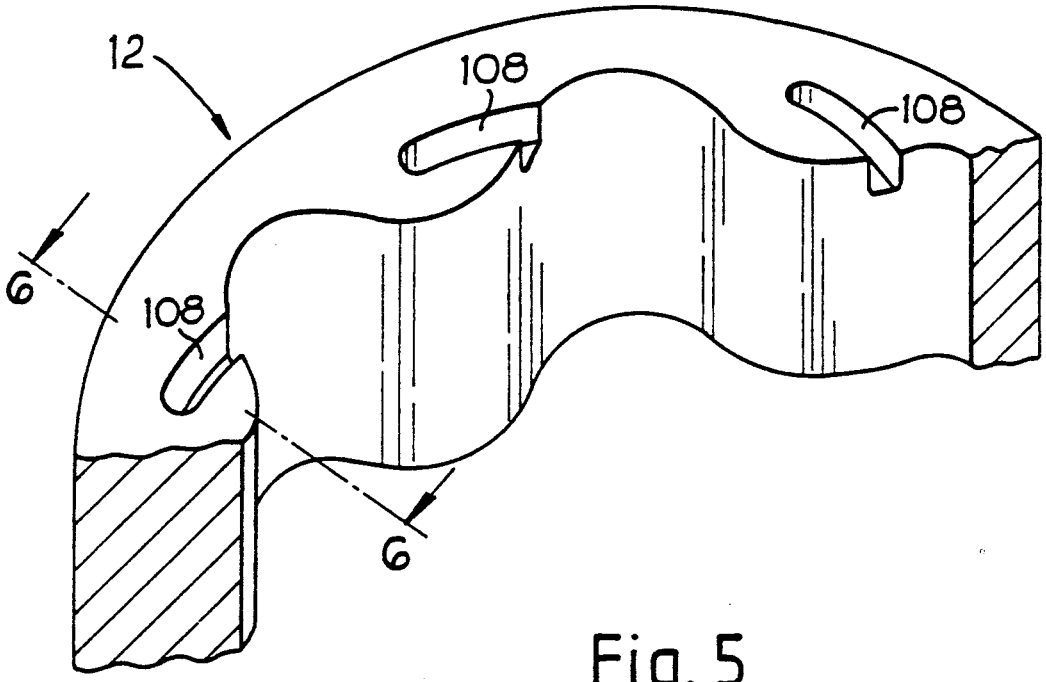
FIG. 5 is a fragmentary enlarged perspective view of the annulus.
Figure 6:
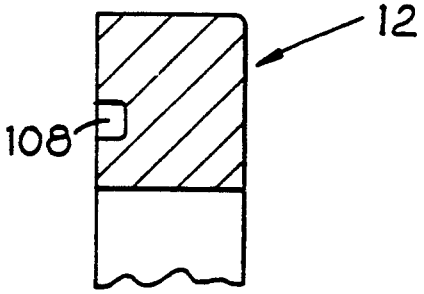
FIG. 6 is a section on the line 6—6 of FIG. 5, similarly on an enlarged scale.
Figure 7:
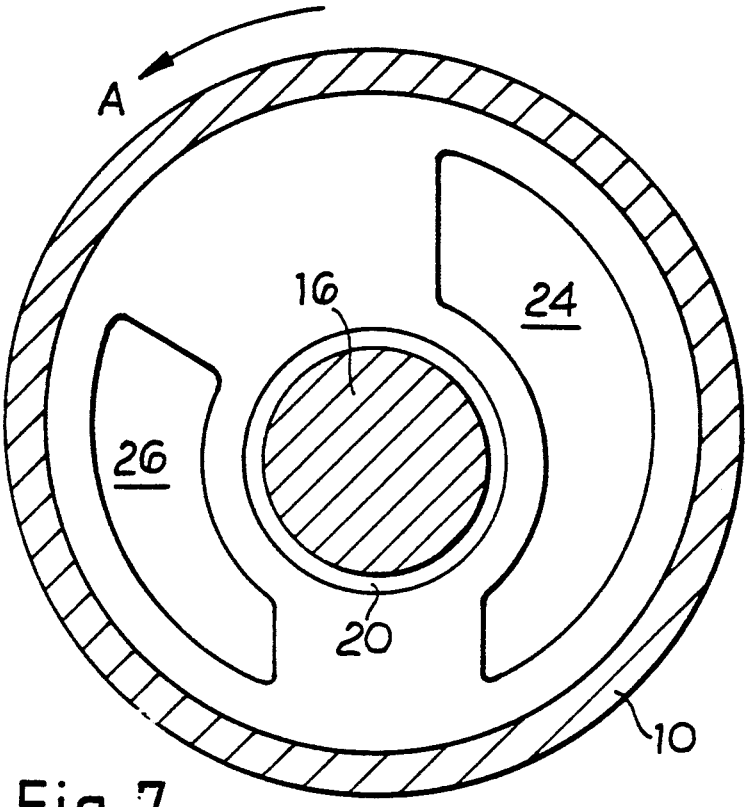
FIG. 7 is a view on the line 7—7 of FIG. 4.

From e.g. FIG. 3 it can be seen that the land width 30 is slightly in excess of the chamber width 32 where land width is defined as the solid body between the two ports and chamber width is the distance between the two lines of contact between both rotor 14 and annulus 12, i.e. at points 34,36.

The annulus, in this illustration has six lobes and the rotor five. The numbers may be varied but are normally in the relationship of n and n+1. The rotor as mentioned makes line contact between each of its lobes and the annulus and these line contacts effectively separate a series of working chambers. The lines are before the crest or radially innermost point of each annulus lobe on the inlet side and after the crest on the outlet side, and naturally vice versa for the position of the lines on the rotor lobes. It will be seen that the working chambers increase in volume as they sweep over the inlet port and so suck fluid into the chambers, and decrease in volume as they pass over the outlet port and so express the fluid through the outlet port.

According to the invention, grooves 108 are provided on the annulus end which register with the outlet port. These grooves may be concentric with the annulus perimeter and lie within the diameter of a circle 110 containing the outer face of the ports, and open from the leading faces of the lobes (convex projections) FIGS. 1-7 or the trailing face FIG. 8, terminating partway across each lobe so as to be blind-ended.

The effect of the FIGS. 1-7 arranged will now be explained. In FIG. 1 the chamber 112 is of maximum size (maximum swept volume). Inlet port 24 is connected with the chamber via area 114. The next (ahead) chamber 116 is diminishing in volume but open to exhaust (outlet) via the area 118.

Figure 2:
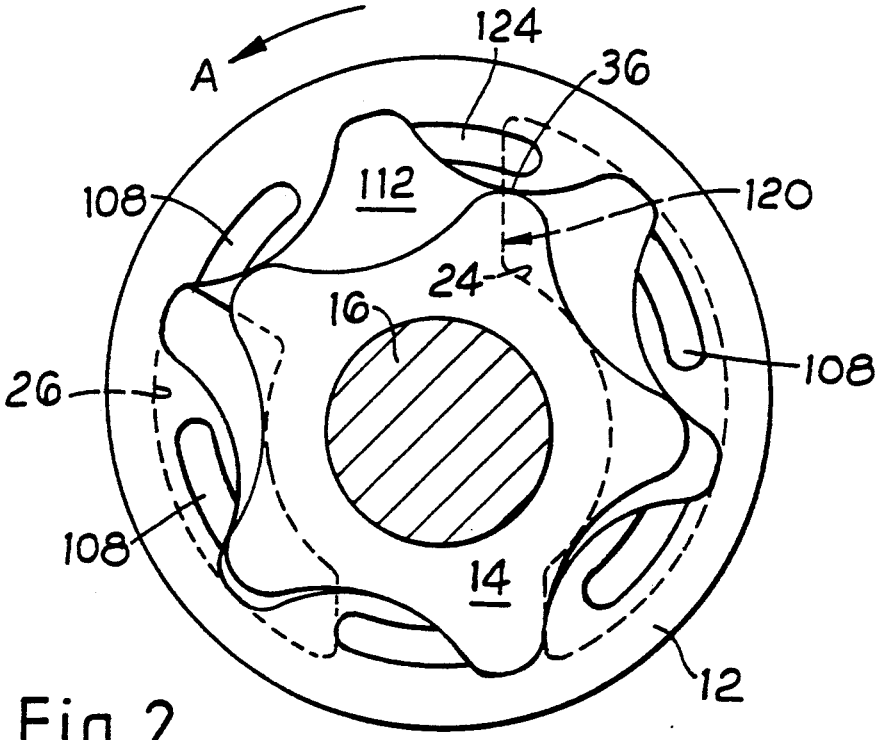

In the intervening position, e.g. as in FIG. 2, whilst chamber 112 diminishes, after it is cut off from the inlet because the line of contact 36 has passed the end face 120 of the inlet port, and before the chamber proper could communicate with the outlet port, undesirable compression of the trapped volume in chamber 112 is avoided by groove 124 which maintains communication between camber 112 and the inlet port until the position shown in FIG. 3 is reached, i.e. until control line 34 (the line of contact/seal between rotor and annulus) passes the end face 128 of the outlet port to allow discharge of high pressure fluid.

The leading edge intersecting grooves of FIGS. 1–7 have no significance at any other position.

Thus, the effect of the groove is to avoid pressure entrapment and undesirable compression in the area of the land, and so reduce noise.

Figure 8:
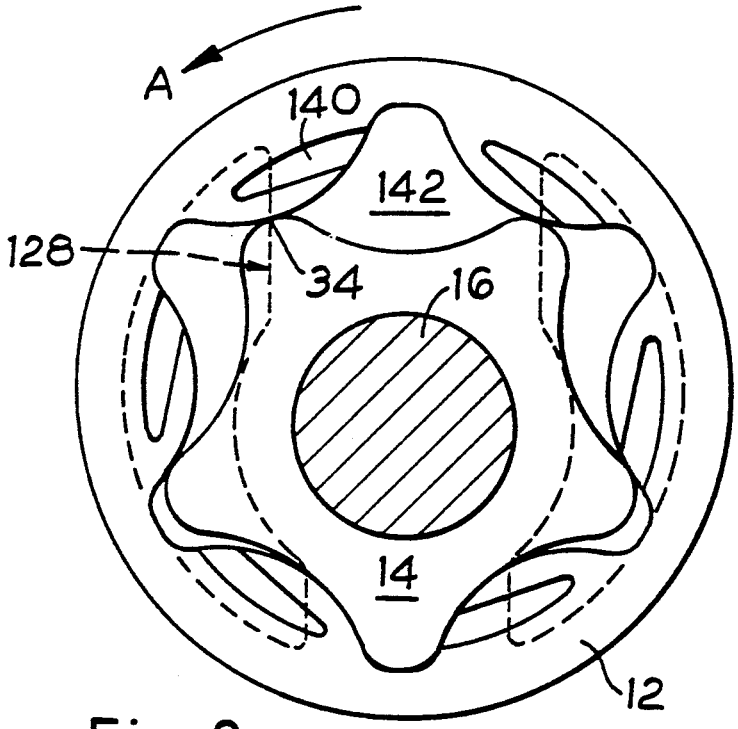
FIG. 8 is a view similar to FIG. 1 of a second embodiment.
Figure 9:
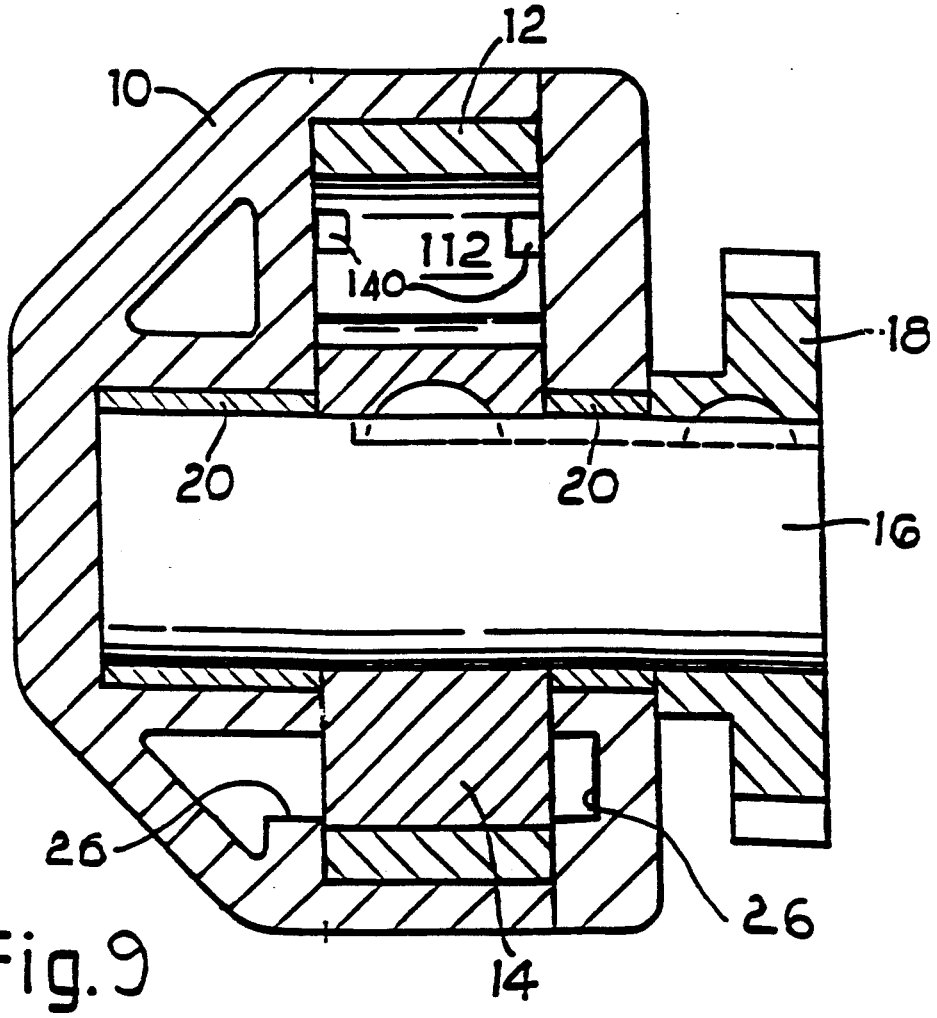
FIG. 9 is a section taken on the line 9—9 of FIG. 3.

The pump of FIG. 8 is assumed to be constructed in general similar fashion to that of FIGS. 1–7 differing only in the profile of the ports, and in that the grooves intersect the trailing face of each lobe. After the foregoing discussion it will be sufficient to point out that, as shown, the groove 140 will intersect the outlet port over the time when the maximum swept volume chamber 142 diminishes in volume before the outlet is connected due to line 34 passing the face 128, thus again avoiding pressure entrapment and noise. The trailing grooves have no other significant effect or result.

Both axial ends of the annulus could be grooved especially if the pump has ports at both ends.

I claim:

1. A gerotor pump comprising an annulus having n+1 female lobes mounted for rotation in one direction about a first axis in a pump body with an outlet port formed in a face adjacent to an axial end of the annulus and an inlet port formed in a face adjacent to an axial end of the annulus, a male rotor having n lobes mounted for rotation about a second axis parallel to the said first axis, said rotor being meshed with said annulus so as to form a series of n working chambers between the lobes which chambers increase and decrease in volume as the parts rotate through successive half revolutions, each chamber being bounded by lines of contact between the lobes, and characterized in that the end face of the annulus adjacent the pump body face which is provided with one of said ports has a blind-end groove extending in a circumferencial direction part-way across each lobe, and wherein each of the blind-end grooves is positioned in the annulus to allow fluid to flow between a working chamber and one of said ports when the working chamber is not registered with the port.

2. A gerotor pump as claimed in claim 1 wherein the grooves extend from the trailing face of each lobe having regard to the direction of rotation.

3. A gerotor pump as claimed in claim 1 wherein the grooves extend from the leading face of each lobe having regard to the direction of rotation.

4. A gerotor pump as claimed in claim 1 wherein the pump body has ports at both axial ends of the gerotor set and said annulus is grooved in like fashion at both ends.

5. A gerotor pump as claimed in claim 1 wherein each of blind-end grooves allows fluid to flow between a working chamber and the inlet port when the working chamber is not registered over the inlet port.

6. A gerotor pump as claimed in claim 1 wherein each of the blind-end grooves allows fluid to flow between a working chamber and the outlet port when the working chamber is not registered over the outlet port.

7. A gerotor pump comprising an annulus having n+1 female lobes mounted for rotation about a first axis in a pump body with a port formed in a face of said pump body adjacent an axial end of the annulus, a male rotor having n lobes mounted for rotation about a second axis parallel to said first axis, said rotor being meshed with said annulus so as to form a series of n working chambers between the lobes, each chamber being bound by lines of contact between the lobes, each of working chambers increasing in volume as the annulus moves through one-half revolution and decreasing in volume as the annulus moves through another half revolution, and characterised in that the end face of the annulus adjacent the pump body face which is provided with said port has a blind-end groove extending in a circumferential direction part-way across each lobe and wherein each blind-end groove is positioned in the annulus to allow fluid flow between a working chamber and said port when the working chamber is not registered with the port.

8. A gerotor pump as claimed in claim 7 wherein said port is an outlet port.

9. A gerotor pump as claimed in claim 7 wherein said port is an inlet port.

* * * * *